US010830046B2

(12) United States Patent
Loerch et al.

(10) Patent No.: US 10,830,046 B2
(45) Date of Patent: Nov. 10, 2020

(54) EXPANSION SYSTEM

(71) Applicant: BITZER Kuehlmaschinenbau GmbH, Sindelfingen (DE)

(72) Inventors: Roni Loerch, Neuenbuerg (DE); Marcus Blumhardt, Rutesheim (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 331 days.

(21) Appl. No.: 15/945,009

(22) Filed: Apr. 4, 2018

(65) Prior Publication Data

US 2018/0223666 A1 Aug. 9, 2018

Related U.S. Application Data

(63) Continuation of application No. PCT/EP2015/072941, filed on Oct. 5, 2015.

(51) Int. Cl.
*F01C 21/00* (2006.01)
*F01K 25/06* (2006.01)
(Continued)

(52) U.S. Cl.
CPC ..... *F01C 21/002* (2013.01); *F01C 1/16* (2013.01); *F01C 13/00* (2013.01); *F01K 21/005* (2013.01); *F01K 25/06* (2013.01)

(58) Field of Classification Search
CPC ..... F01C 13/00; F01C 1/16; F01C 21/002; F01K 21/005; F01K 25/06
See application file for complete search history.

(56) References Cited

U.S. PATENT DOCUMENTS 5,823,294 A * 10/1998 Mizutani ..... F04B 27/109 184/6.3
9,670,823 B2 * 6/2017 Hayman ..... F01P 3/02
(Continued)

FOREIGN PATENT DOCUMENTS

DE 102012016812 A1 2/2014
DE 102014206023 A1 10/2015
(Continued)

*Primary Examiner* — Jesse S Bogue
(74) *Attorney, Agent, or Firm* — Reinhart Boerner Van Deuren P.C.

(57) ABSTRACT

In order to improve an expansion system for a working medium that is used in particular in a circulating process of a system that utilises waste heat, in particular in a system operating in a Rankine cycle, comprising an expansion device coupled to an electricity generator, for the working medium, an inlet for supplying the pressurised working medium, and an outlet for the working medium that has been expanded by the expansion device, it is proposed that an aerosol generator unit that generates a lubricant aerosol should be associated with the inlet, wherein the working medium guided to the expansion device flows through this aerosol generator unit, which has a flow guide for the working medium having a concentration section that concentrates lubricant entrained in the total mass flow of working medium supplied to the expansion device to give aerosol particles, and these aerosol particles leave the concentration section together with a partial mass flow of the working medium, branching off from the total mass flow of working medium, as a lubricant aerosol mass flow, and that a line system should be provided that guides the lubricant aerosol mass flow to lubrication points of an expansion arrangement of the expansion device, for the purpose of aerosol lubrication.

33 Claims, 7 Drawing Sheets

(51) Int. Cl.

| | |
|---|---|
| ***F01K 21/00*** | (2006.01) |
| ***F01C 1/16*** | (2006.01) |
| ***F01C 13/00*** | (2006.01) |

(56) References Cited

U.S. PATENT DOCUMENTS

| | | | | |
|---|---|---|---|---|
| 9,732,616 | B2 * | 8/2017 | Schuster | F04D 29/06 |
| 10,202,872 | B2 * | 2/2019 | Aumann | F01K 7/22 |
| 2008/0289335 | A1 * | 11/2008 | Drysdale | F01D 15/005 60/649 |
| 2009/0246061 | A1 * | 10/2009 | Iijima | F04C 29/026 418/97 |
| 2010/0034684 | A1 | 2/2010 | Ast et al. | |
| 2011/0265476 | A1 * | 11/2011 | Berger | F01K 13/02 60/651 |
| 2012/0237382 | A1 | 9/2012 | Yoshimura | |
| 2015/0275699 | A1 * | 10/2015 | Waibel | F01K 7/165 60/615 |

FOREIGN PATENT DOCUMENTS

| | | | |
|---|---|---|---|
| EP | 2161417 | A1 | 3/2010 |
| EP | 2662539 | A1 | 11/2013 |
| EP | 2743464 | A1 | 6/2014 |
| GB | 2427002 | A | 12/2006 |

* cited by examiner

EXPANSION SYSTEM

CROSS-REFERENCE TO RELATED PATENT APPLICATION

This application is a continuation of International application number PCT/EP2015/072941 filed on Oct. 5, 2015.

This patent application claims the benefit of International application No. PCT/EP2015/072941 filed on Oct. 5, 2015, the teachings and disclosure of which are hereby incorporated in their entirety by reference thereto.

BACKGROUND OF THE INVENTION

The invention relates to an expansion system for a working medium that is used in particular in a circulating process of a system that utilises waste heat, in particular in a system operating in a Rankine cycle, comprising an expansion device coupled to an electricity generator, for the working medium, an inlet for supplying the pressurised working medium, and an outlet for the working medium that has been expanded by the expansion device.

Expansion systems of this kind are known for example from EP 2 743 464 A1.

In these expansion systems, the working medium in the circulating process always entrains lubricant, and this is deposited in the expansion system and becomes available as liquid for lubricating the expansion system.

The object of the invention is to improve lubrication in an expansion system of the type mentioned in the introduction.

SUMMARY OF THE INVENTION

This object is achieved according to the invention with an expansion system of the type mentioned in the introduction in that an aerosol generator unit that generates a lubricant aerosol is associated with the inlet, wherein the working medium guided to the expansion device flows through this aerosol generator unit, which has a flow guide for the working medium having a concentration section that concentrates lubricant entrained in the total mass flow of working medium supplied to the expansion device to give aerosol particles, and these aerosol particles leave the concentration section together with a partial mass flow of the working medium, branching off from the total mass flow of working medium, as a lubricant aerosol mass flow, and in that there is provided a line system that guides the lubricant aerosol mass flow to lubrication points of an expansion arrangement of the expansion device, for the purpose of aerosol lubrication.

The advantage of the solution according to the invention lies in the fact that it does not follow EP 2 743 464, separating the lubricant off from the working medium as a liquid in order to lubricate the expansion arrangement with the lubricant as a liquid, but on the contrary only concentrates the lubricant to give aerosol particles which then, together with a partial mass flow branching off from the total mass flow of working medium, form a lubricant aerosol mass flow that is then supplied to the different lubrication points, for the purpose of aerosol lubrication.

Thus, the fact that the lubricant can be concentrated in the working medium to give an aerosol is utilised to avoid the separation of the lubricant from the working medium to form a liquid, as is known from the prior art, and to supply the aerosol particles to the expansion arrangement along with a partial flow of the working medium, for the purpose of aerosol lubrication, which has proved particularly advantageous for the expansion arrangement.

Within the scope of the solution according to the invention, the aerosol lubrication takes place using a lubricant aerosol mass flow that has a lubricant proportion in the region of from 2 mass % (mass percent) to 30 mass % (mass percent), preferably 3 mass % to 20 mass %.

A particularly favourable solution provides for the aerosol generator unit to deflect the direction of flow in the concentration section of the total mass flow entering therein, for the purpose of forming the main mass flow that is supplied to the expansion arrangement, through overall at least 60°, or preferably through at least 90°, and to branch off the lubricant aerosol mass flow from the total mass flow in the region of deflection of the direction of flow.

It is particularly favourable if the aerosol generator unit deflects the direction of flow in the concentration section of the total mass flow entering therein, for the purpose of forming the main mass flow that is supplied to the expansion arrangement, through overall at least 140°.

More detailed statements have not yet been made as regards the direction of flow in which the lubricant aerosol mass flow flows out of the concentration section of the aerosol generator unit.

Thus, a particularly favourable solution provides for the lubricant aerosol mass flow to flow out of the concentration section of the aerosol generator unit in a direction of flow that forms an angle of at least 60°, in particular an angle of at least 90°, with the direction of flow of the main mass flow that is formed.

It is even more preferable if the lubricant aerosol mass flow flows out of the concentration section of the aerosol generator unit in a direction of flow that forms an overall angle of greater than 140°, preferably overall approximately 180°, with the direction of flow of the main mass flow that is formed.

Furthermore, more detailed statements have likewise not been made as regards the direction of flow of the lubricant aerosol mass flow in relation to the direction of flow of the total mass flow entering the concentration section.

Thus, a further advantageous solution provides for the lubricant aerosol mass flow to flow out of the concentration section of the aerosol generator unit in a direction of flow that forms an angle of less than 120°, or preferably an angle of less than 90°, particularly preferably an angle of less than 45°, with the direction of flow of the total mass flow entering the concentration section.

The aerosol generator unit according to the invention works to particular advantage if it has in the concentration section a flow cross section constriction that increases the flow rate.

Furthermore, the action of a flow cross section constriction is further improved if the aerosol generator unit has, downstream of the flow cross section constriction, a flow cross section widening for the purpose of reducing the flow rate of the total mass flow, in order to prevent the aerosol particles from being entrained by the main mass flow.

More detailed statements have not yet been made specifically as regards the form taken by the aerosol generator unit.

Thus, an advantageous solution provides for the aerosol generator unit to have a receiving chamber which the total mass flow enters and for the total mass flow to flow out of the receiving chamber and into the concentration section.

Preferably, here, the flow rate is reduced in the receiving chamber, while the flow rate is increased in the concentration section.

In particular, the concentration section takes a form such that there are provided therein one or more passage windows or a passage aperture whereof the flow cross sections are smaller than the flow cross section in the receiving chamber, for the purpose of forming the flow cross section constriction.

In particular, for this reason it is favourable if a flow cross sectional area of the passage window or passage aperture is adjustable.

For the generation of the lubricant aerosol mass flow it is further favourable if the aerosol generator unit has an exit chamber arranged downstream of the concentration section.

In particular here it is advantageous if the flow rate is reduced in the exit chamber by comparison with the flow rate in the concentration section.

Furthermore, it is preferably provided for the aerosol generator unit to have a central chamber and an annular chamber surrounding the latter, for the concentration section to be arranged in a region of transition from the annular chamber to the central chamber, and for either the annular chamber or the central chamber to form the receiving chamber and either the central chamber or the annular chamber respectively to form the exit chamber.

With this solution, it is particularly favourable if the aerosol generator unit has a guide sleeve that separates the annular chamber from the central chamber, and at the end whereof there is arranged the concentration section.

Preferably, the guide sleeve may take a form such that at the end thereof it has a flow cross section constriction in the concentration section.

A particularly favourable solution provides for the annular chamber to include the receiving chamber such that the total mass flow enters the annular chamber and passes from the annular chamber via the concentration section into the exit chamber, wherein in particular a passage window is arranged in the concentration section.

Furthermore, more detailed statements have not been made in conjunction with the solutions described hitherto as regards how the lubricant aerosol mass flow is to flow away.

Preferably, for this purpose it is provided for there to adjoin the concentration section an exit aperture through which the lubricant aerosol mass flow passes.

This exit aperture is preferably provided in a wall delimiting the concentration section.

In the case of a flow cross section constriction in the concentration section, it is preferably provided for the exit aperture to be arranged in the region of the flow cross section constriction.

A further advantageous solution provides for the exit aperture to be arranged downstream of the flow cross section constriction.

More detailed statements have not yet been made specifically as regards the form taken by the expansion arrangement.

Thus, in theory the expansion arrangement could take the form of a piston machine or turbine.

An advantageous solution provides for the expansion arrangement to be a screw expansion arrangement that includes two screw rotors engaging in one another.

Preferably, in the solution according to the invention it is provided for the lubricant aerosol mass flow to be supplied to at least one bearing unit or to the bearing units of the expansion arrangement.

The lubricant aerosol mass flow is preferably supplied to the provided lubrication points by way of a line system.

This line system is either a line system formed outside the housing or is integrated into the housing.

Arranged in the line system is for example a flow detection element and/or a heat exchanger and/or a post-treatment unit, for example a filter.

In a screw expansion arrangement of this kind, lubrication thereof supplements for example lubrication by the lubricant entrained in the main mass flow, such that the lubricant aerosol mass flow is also supplied to at least one point on the respective screw rotor bore receiving a screw rotor.

Furthermore, it is favourable if, for the purpose of additional lubrication of the screw rotors, the lubricant aerosol mass flow is supplied to the respective screw rotor bore at a plurality of points corresponding to different expansion states.

In principle, the lubricant aerosol mass flow could be supplied at the respective point by way of an end aperture of the line system.

For the purpose of improving lubrication, it is provided for the lubricant aerosol mass flow to be supplied at the respective point by way of a nozzle that distributes the lubricant aerosol mass flow.

The invention also relates to a method for operating an expansion system for a working medium that is used in particular in a circulating process of a system that utilises waste heat, in particular in a system operating in a Rankine cycle, including an expansion device coupled to an electricity generator, for the working medium, an inlet for supplying the pressurised working medium, and an outlet for the working medium that has been expanded by the expansion device, in which the working medium is guided in an aerosol generator unit that generates a lubricant aerosol and is associated with the inlet such that lubricant entrained in the total mass flow of working medium guided to the expansion device is concentrated to give aerosol particles, and from these aerosol particles, together with a partial mass flow of the working medium, branching off from the total mass flow of working medium, there is formed a lubricant aerosol mass flow, which is supplied to lubrication points of the expansion arrangement of the expansion device by a line system.

An advantageous further development of this method provides here for the direction of flow of the total mass flow entering a concentration section in the aerosol generator unit to be deflected therein, for the purpose of forming a main mass flow that is supplied to the expansion arrangement, through at least 60°, in particular at least 90°, and for the lubricant aerosol mass flow to branch off at the location of deflection of the direction of flow.

In the solution according to the invention, it is advantageous for formation of the lubricant aerosol mass flow if, in the aerosol generator unit, the lubricant aerosol mass flow flows away, in the region of a deflection of flow from the direction of flow of the total mass flow into the direction of flow of the main mass flow, in a direction of flow that is different from the direction of flow of the main mass flow.

In particular, it is advantageous for the formation of a suitable lubricant aerosol mass flow if, in a concentration section of the aerosol generator unit, the lubricant aerosol mass flow is guided away in a direction of flow that forms an angle of at least 60°, or preferably at least 90°, even more preferably at least 140°, preferably approximately 180°, that is to say 180°±20°, with the direction of flow of a main mass flow that is flowing away.

Furthermore, it is favourable for the formation of the lubricant aerosol mass flow if, in a concentration section of the aerosol generator unit, the lubricant aerosol mass flow is guided away in a direction of flow that forms an angle of less than 90°, more preferably less than 45°, and even more preferably less than 20°, with the direction of flow of the total mass flow entering the concentration section.

For the formation of the aerosol particles, it is favourable if the flow rate is increased in the aerosol generator unit at the location of formation of the lubricant aerosol mass flow from the total mass flow.

Furthermore, it is favourable for collection of the aerosol particles if the flow rate of the total mass flow is reduced in the aerosol generator unit downstream of the flow cross section constriction.

Further features and advantages of the invention form the subject matter of the description below and the representation in the drawing of some exemplary embodiments.

DETAILED DESCRIPTION OF THE INVENTION

Figure 1:
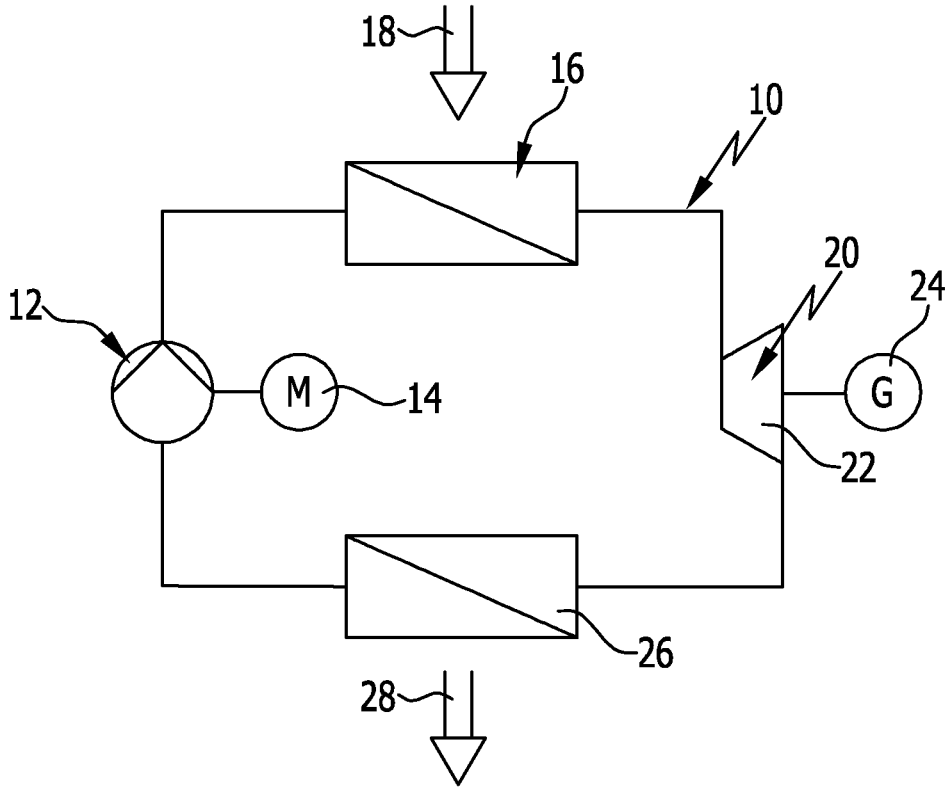
FIG. 1 shows a schematic illustration of a circulating process.

In a circulating process illustrated in FIG. 1, in particular a circulating process operating in a Rankine cycle, a working medium that is guided in a circuit 10 is compressed by a compressor 12 that is driven by a motor 14.

In a downstream heat exchanger 16, the working medium is evaporated as a result of supplying heat from a heat flow 18, then supplied to an expansion system 20 that is arranged in the circuit 10 and includes an expansion device 22 that drives a generator 24 used for the generation of electricity.

Then, the working medium is condensed in a heat exchanger 26 that is arranged in the circuit 10, a heat flow 28 being guided away.

The condensed working medium is then supplied to the compressor 12 again.

In particular, the compressor 12 performs an isentropic, in particular an ideal isentropic, compression of a liquid-saturated condensate of the working medium that is generated by the heat exchanger 26, and an isobaric evaporation of the undercooled system is performed in the heat exchanger 16 until the vapour-saturated state is achieved, in which the working medium is then supplied to the expansion system 20, during which mechanical work is produced by expansion, driving the generator 24.

Finally, in the heat exchanger 26 an isobaric, in particular completely isobaric, condensation of the working medium takes place by guiding away the heat flow 28, so that a liquid-saturated condensate can then be supplied to the compressor 12 again.

As the working medium, in particular organic working media such as R245fa or similar media are used.

Preferably, a circulating process of this kind serves to utilise industrial waste heat which occurs for example in the range between 100° C. and 700° C., wherein this waste heat can be converted into electrical energy by the circulating process described above.

Figure 2:
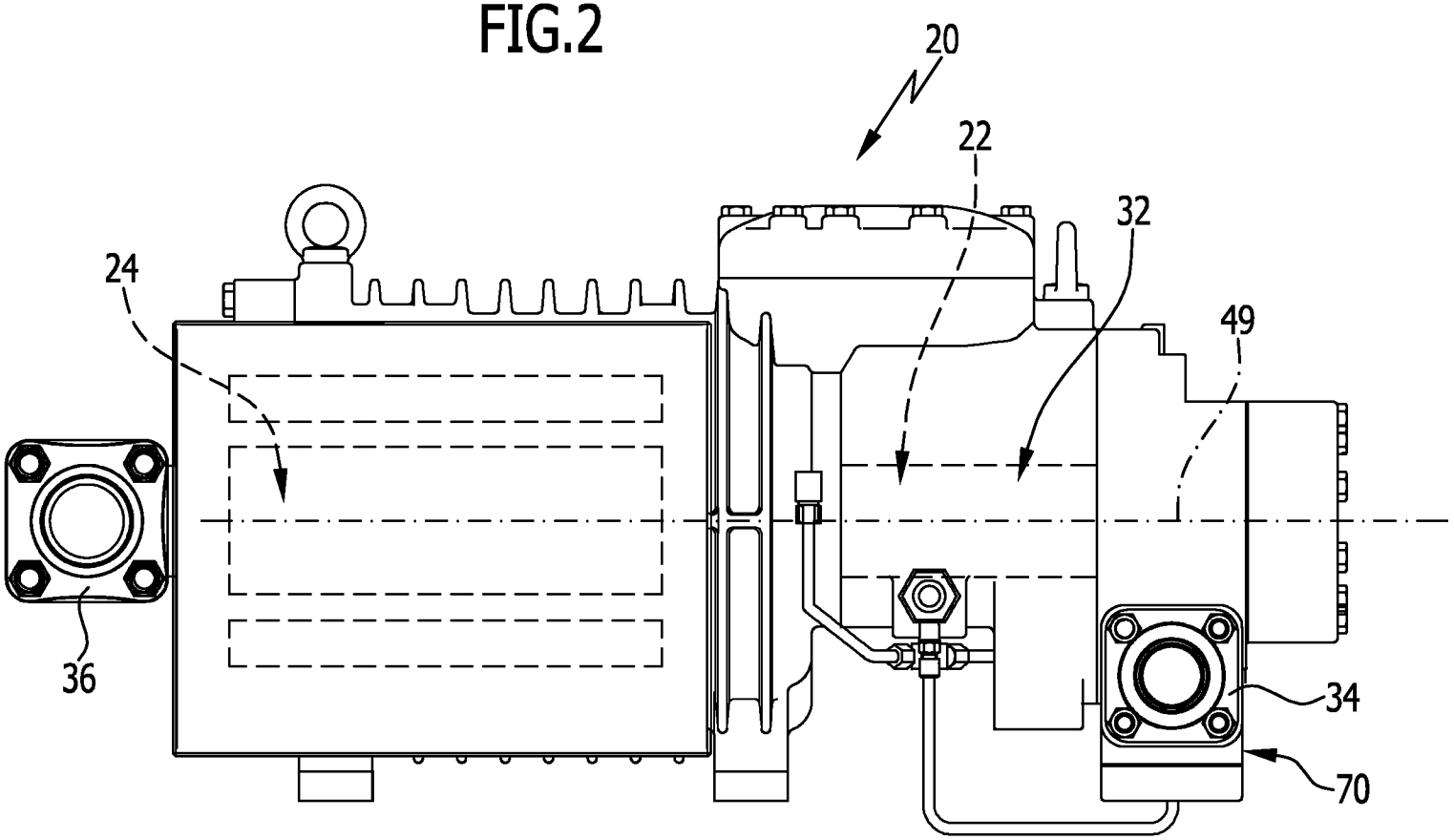
FIG. 2 shows an illustration of an expansion system.

FIG. 2 illustrates by way of example an expansion system 20 of this kind whereof the expansion device 22 is coupled to the generator 24, wherein the generator 24 and the expansion device 22 are arranged in a common housing 32 and grouped together to form a unit.

A total mass flow G of the working medium that is to be compressed by the compressor 12 is supplied by way of an inlet 34 of the expansion device 22, with the working medium then flowing through the expansion device 22.

After flowing through the expansion device 22, the working medium flows through the generator 24 that is arranged in the housing 32, and finally the working medium leaves the housing 32 by way of an outlet 36, wherein the expanded working medium that prevails downstream of the expansion device 22 at the same time brings about cooling of the generator 24 in the housing 32.

Preferably here, the outlet 36 is arranged on the housing 32 on an opposite side of the generator 24 to the expansion device 22.

Figure 3:
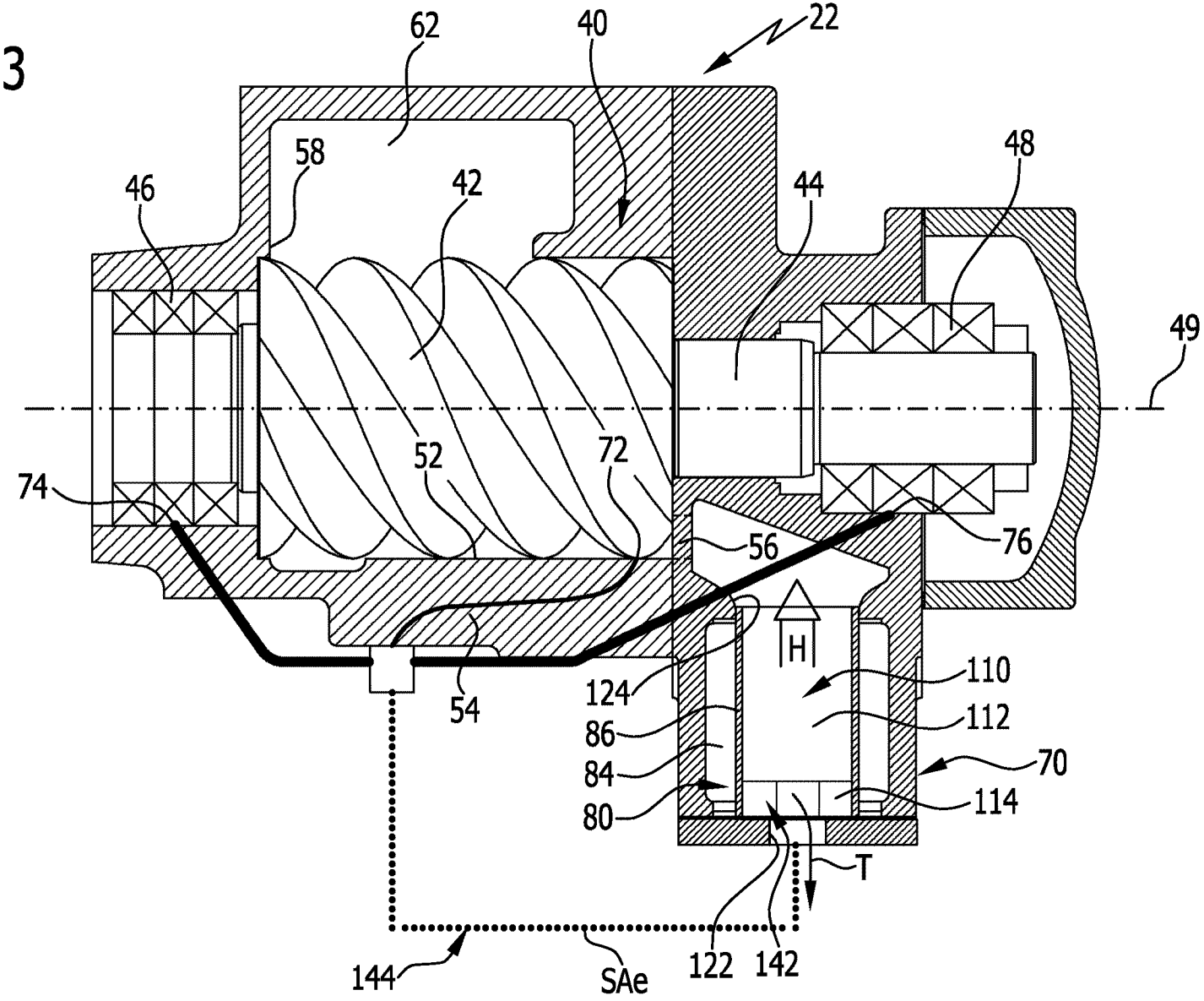
FIG. 3 shows a partial section through the expansion device, in the region of an expansion arrangement and an aerosol generator unit.

As illustrated in FIG. 3, the expansion device, which is designated 22 as a whole, includes an expansion arrangement 40 that takes the form for example of a screw expansion arrangement and has two screw rotors 42 each of which is seated on a screw rotor shaft 44, wherein the screw rotor shafts 44 are mounted in rotary bearing units 46, 48, rotatably about the respective axes of rotation 49, on either side of the screw rotors 42.

In particular, the two screw rotors 42 engage in one another and are each arranged in one of two overlapping screw rotor bores 52 in a screw rotor housing 54, wherein the screw rotor housing 54 has an inlet window 56 for the working medium on one side, and has an outlet window 58 that is substantially opposed to the inlet window 56 and through which the working medium that has been expanded by the screw rotors 42 rotating about their respective axes of rotation 49 leaves.

From the exit window 58, the working medium is then supplied to the generator 24, which is likewise arranged in the housing 32, by way of an exit duct 62 and preferably flows around the generator 24 for the purpose of cooling the latter.

Figure 4:
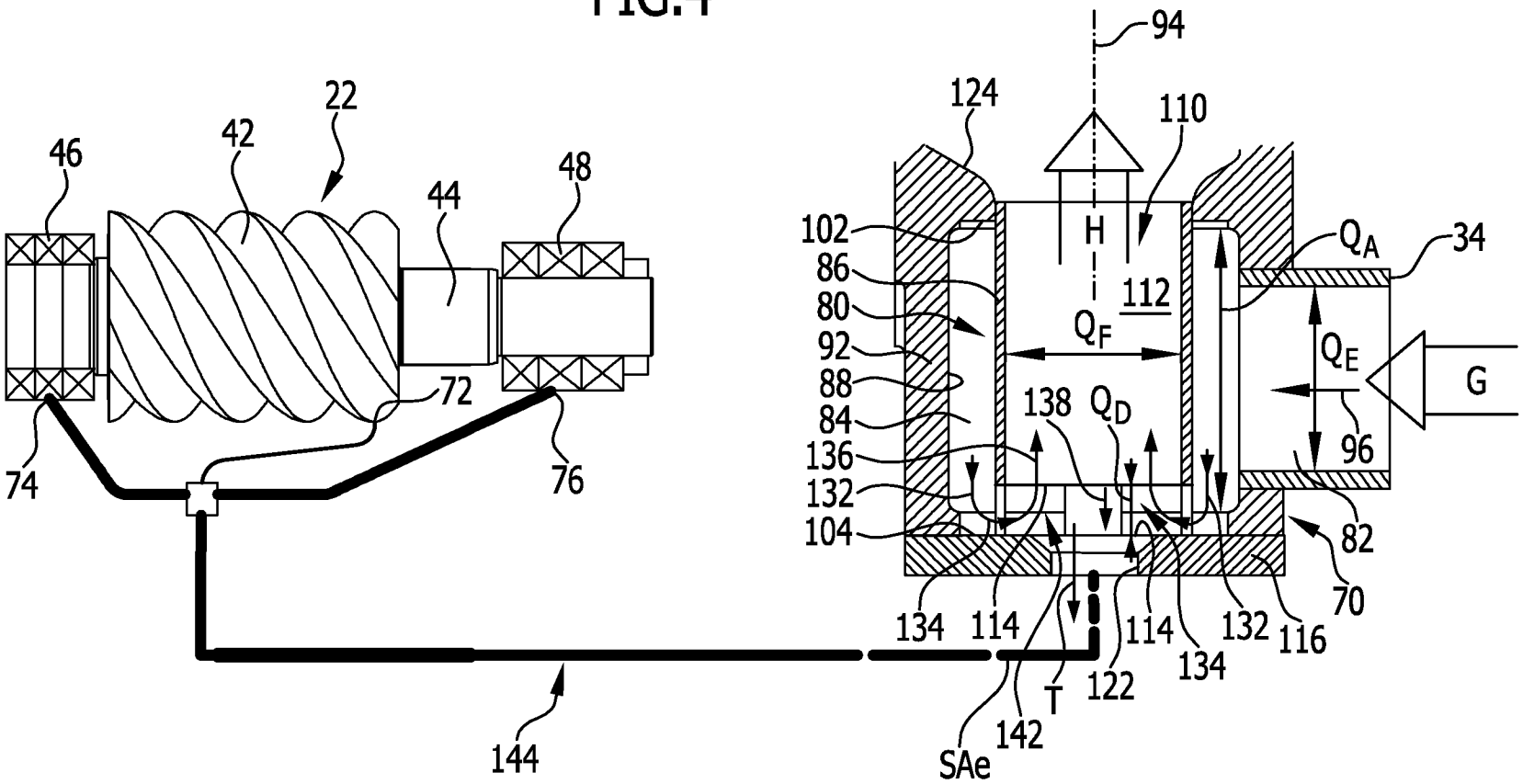
FIG. 4 shows an enlarged illustration of the lubricant generator unit, together with a schematic illustration of a section of the expansion arrangement.

The expansion device 22 includes an aerosol generator unit 70, which is arranged between the inlet 34 for the working medium and the inlet window 56, as illustrated in FIGS. 2 and 3, and is designated 70 as a whole, and which serves, from a total mass flow G of the working medium that enters the aerosol generator unit 70 by way of the inlet 34, to concentrate the lubricant that is entrained by the total mass flow G to give aerosol particles, and from these aerosol particles to form, together with a partial mass flow of the working medium that branches off from the total mass flow G of working medium, a lubricant aerosol mass flow SAe, which as illustrated in FIG. 4 is guided away from the aerosol generator unit 70 and supplied to lubrication points 72 to 76 of the expansion arrangement 40, wherein for example the lubrication point 72 is located in one of the screw rotor bores 52, in particular close to the inlet thereof, the lubrication point 74 is associated with the rotary bearing unit 46, and the lubrication point 76 is associated with the rotary bearing unit 48.

Thus, it is possible using the lubricant aerosol mass flow SAe to lubricate both the screw rotors 42 in the corresponding screw rotor bores 52 and/or the rotary bearing unit 46 and 48 without the need to generate liquid lubricant and supply it as a liquid to the corresponding lubrication points 72.

As illustrated in detail in FIG. 4, in a first exemplary embodiment of the expansion device 22 according to the invention the aerosol generator unit 70 is directly associated with the inlet 34, wherein the total mass flow G enters a receiving chamber 80 of the aerosol generator unit 70, including an annular chamber 84, by way of an inlet duct 82, wherein the annular chamber 84 is arranged between a guide sleeve 86 and an inner wall 88 of a housing 92 of the aerosol generator unit 70, wherein the annular chamber 84 and the guide sleeve 86 are arranged to surround a centre axis 94, and wherein the centre axis 94 extends transversely, preferably perpendicular, to a direction of flow 96 of the total mass flow G in the inlet duct 82.

Preferably, the inlet duct 82 is arranged such that, in a central region of the receiving chamber 80 that extends in the direction of the centre axis 94 and takes the form of an annular chamber 84, the inlet duct 82 opens into the receiving chamber 80.

The receiving chamber 80 is closed off by the housing 92 of the aerosol generator unit 70 in the direction of the centre axis 94, by annular transverse walls 102 and 104 of the housing 92 that extend between the guide sleeve 86 and the inner wall 88.

In order to allow the total mass flow G to pass from the receiving chamber 80 into an exit chamber 110 of the aerosol generator unit 70, which is for example in the form of a central chamber 112 of the guide sleeve 86, the guide sleeve 86 is provided with passage windows 114 that are arranged peripherally around the centre axis 94 and are in particular arranged at the end of the guide sleeve 86, for example adjoining the transverse wall 104.

For example, a flow cross sectional area of the passage windows 114 may be adjusted by displacing the guide sleeve 86.

Here, for example the transverse wall 104 is formed by a termination 116 of the housing 92.

Arranged in the transverse wall 104 is an exit aperture 122 that lies within the guide sleeve 86, is preferably arranged coaxially to the centre axis 94, and serves to allow the lubricant aerosol mass flow SAe to leave.

Opposite the exit aperture 122, the central chamber 112 of the guide sleeve 86 merges into a transfer duct 124 that leads to the inlet window 56 of the expansion arrangement 40.

The total mass flow G, which is guided in the inlet duct 82 of cross section $Q_E$, undergoes a deceleration in flow on entering the receiving chamber 80 because of an increase in cross section to a cross sectional area $Q_A$, wherein the total mass flow G is distributed over the entire receiving chamber 80, that is to say in the entire annular chamber 84 around the guide sleeve 86, and undergoes a deflection in flow, with the result that the total mass flow G flows towards the traverse wall 104, in a direction of flow 132 that is approximately parallel to the centre axis 94.

As it comes from the receiving chamber 80, the total mass flow G is deflected through approximately 90° by the transverse wall 104 and passes through the passage window 114, whereof the cross sectional area is significantly smaller than the cross sectional area $Q_A$ and the cross sectional area $Q_E$, with the result that there is a significant increase in the flow rate as it passes through the passage window 114.

Here, and as shown in FIG. 4, on its way from the annular chamber 84 through the passage window 114 the total mass flow G undergoes a deflection, initially through approximately 90°, that is caused by the transverse wall 104, since as the total mass flow passes through the passage window 114 it is first deflected from the direction of flow 132 approximately parallel to the centre axis 94 and into a direction of flow 134 that is approximately radial in relation to the centre axis.

Within the guide sleeve 86, the great majority of the total mass flow G of the working medium undergoes a further deflection through approximately 90°, into a direction of flow 136 that extends away from the passage windows 114 to the exit chamber 110 and in the direction of the transfer duct 124, and approximately parallel to the centre axis 94.

This part of the total mass flow G, which is propagated in the direction of flow 136, forms a main mass flow H that passes out of the exit chamber 110 in the guide sleeve 86 and into the transfer duct 124 and from there, via the inlet window 56, enters the expansion arrangement 40, there to undergo the expansion described above.

Thus, overall the aerosol generator unit 70 provides a flow guidance for the working medium that results in the working medium undergoing deflection a plurality of times.

As a result of the deflection of the total mass flow G from the direction of flow 132 that is directed towards the transverse wall 104, and the deflection caused by the transverse wall 104, into the direction of flow 134, through approximately 90°, there is already a concentration of lubricant entrained in the working medium to give aerosol particles, and this is further intensified by the deflection after it passes through the passage window 114, from the direction of flow 134 into the direction of flow 136, likewise through approximately 90°.

Thus, a flow guidance section that deflects the flow of working medium from the direction of flow 132 into the direction of flow 136, lying on either side of the passage apertures 114, and including the passage apertures 114, forms a concentration section 142 in which the aerosol particles are concentrated and, in association therewith, are in particular made larger.

An appreciable proportion of the quantity of aerosol particles does not follow the flow of working medium in the direction of flow 136 but accumulates close to the exit aperture 122 and is guided, by a partial flow T of the working medium that branches off from the total mass flow G, through the exit aperture 122 in a direction of flow 138, wherein the partial mass flow T, together with the concentrated and enlarged aerosol particles, forms the lubricant aerosol mass flow SAe that moves through the exit aperture 122 in the direction of flow 138.

Here, the direction of flow 138 forms an angle of approximately 180° with the direction of flow 136 in which the main mass flow H leaves the concentration section 142, while the direction of flow 138 is oriented approximately parallel to the direction of flow 132 in which the total mass flow G enters the concentration section 142.

After the exit aperture 122, the lubricant aerosol mass flow SAe is supplied by way of a line system 144 to the lubrication points 72, 74 and 76 for the purpose of aerosol lubrication, wherein the line system 144 either runs outside the housing 32 or is integrated into the housing 32.

Figure 5:
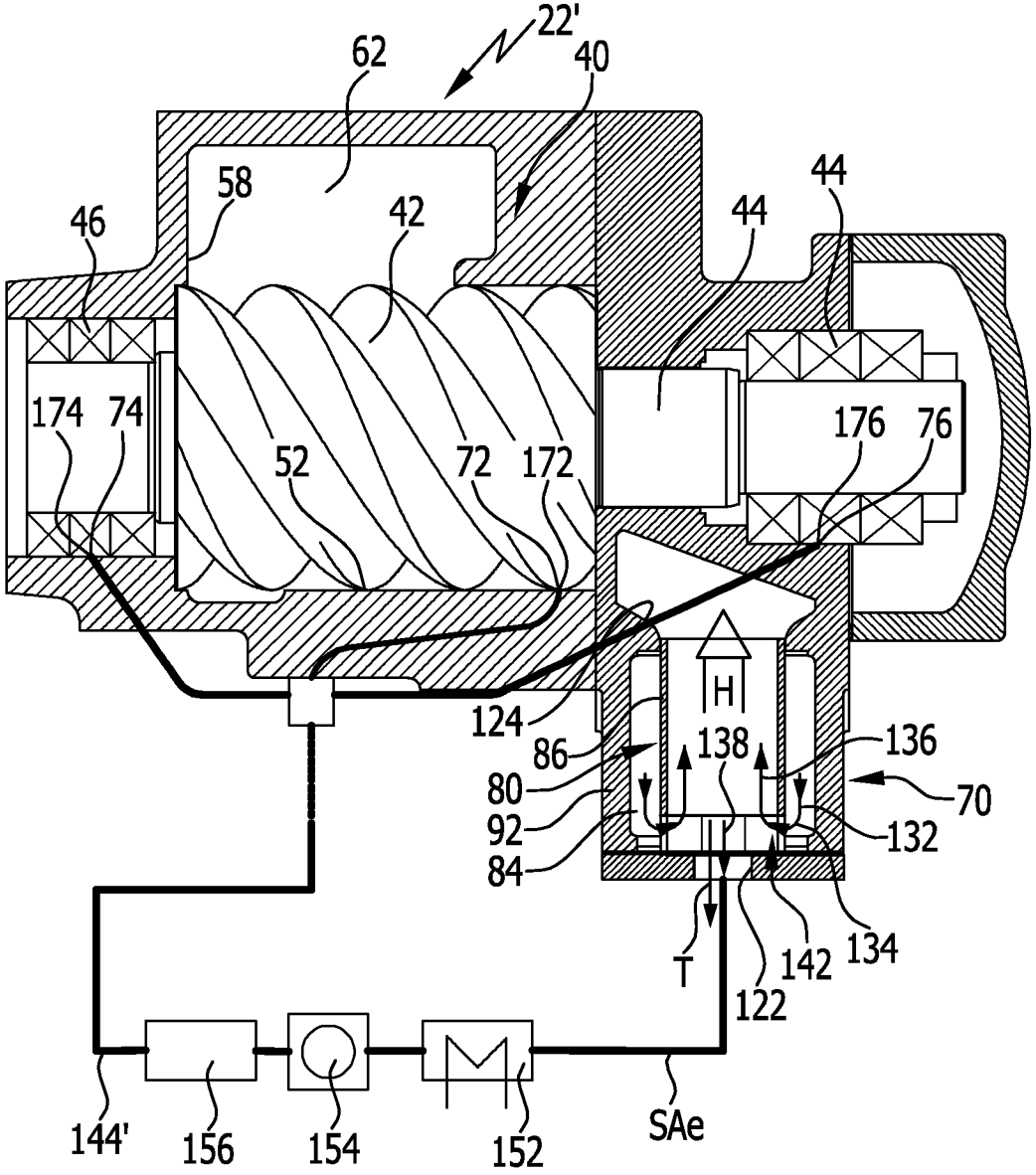
FIG. 5 shows an illustration, similar to FIG. 3, of a second exemplary embodiment of the expansion device according to the invention.

In a second exemplary embodiment of an expansion device 22' according to the invention, illustrated in FIG. 5, the aerosol generator unit 70 takes the same form as in the first exemplary embodiment, but the line system 144' additionally includes a heat sink 152 for cooling the lubricant aerosol mass flow, an inspection glass 154 for monitoring the lubricant aerosol mass flow, and where appropriate a filter 156 for separating off coarse particles from the lubricant aerosol mass flow SAe, and where appropriate also a flow detection element and where appropriate also a post-treatment element for the aerosol mass flow.

The use of a filter 156 is particularly advantageous if the lubrication points 72, 74, 76 are provided with nozzles 172, 174, 176 that serve to finely divide the respective portion of the lubricant aerosol mass flow.

Otherwise, in the second exemplary embodiment of the expansion device 22', all the elements that are identical to the equivalent in the first exemplary embodiment are provided with the same reference numerals, so for a description thereof reference is made in full to the statements regarding the first exemplary embodiment.

Figure 6:
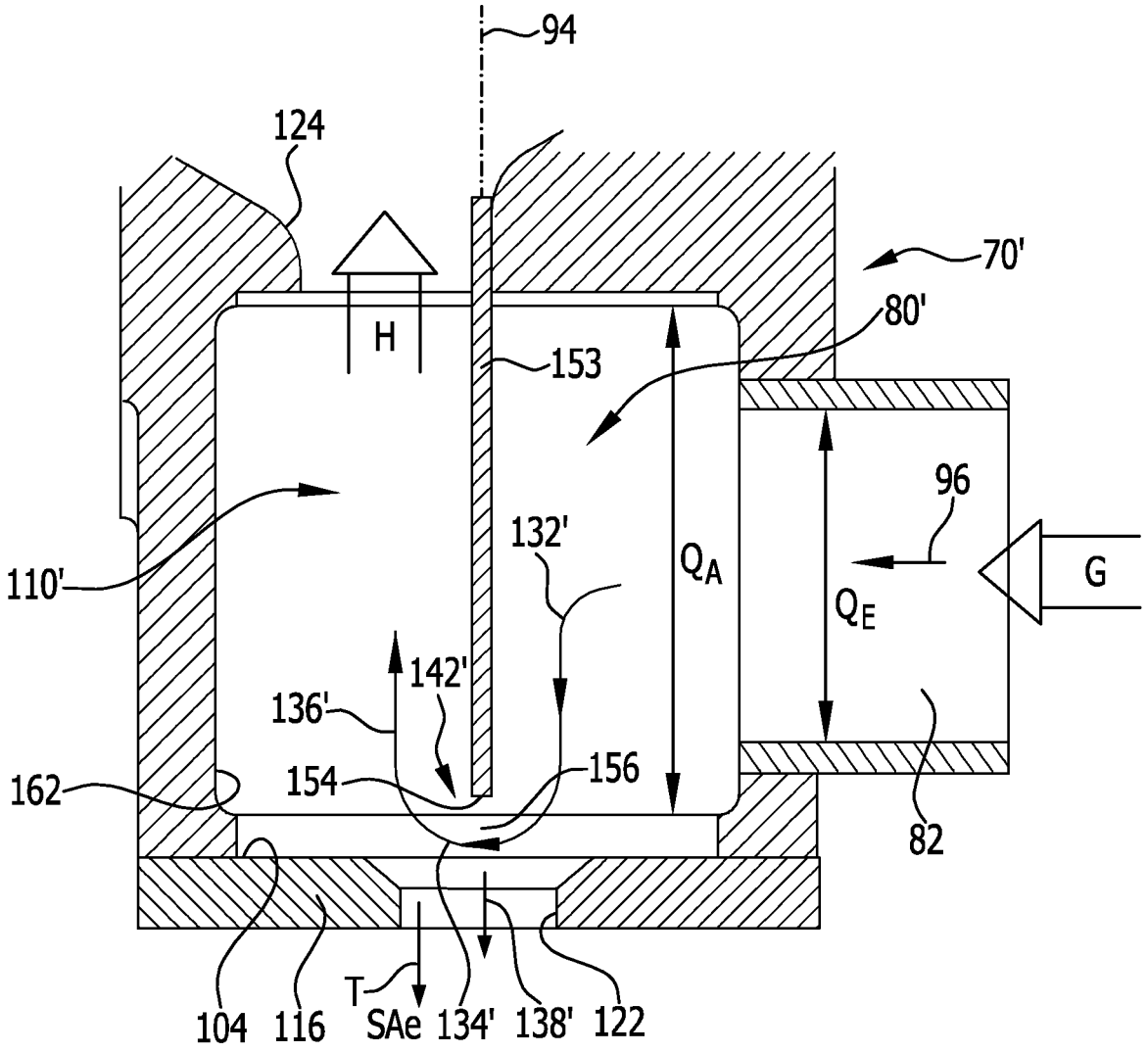
FIG. 6 shows an illustration of the aerosol generator unit, in a third exemplary embodiment of an expansion device according to the invention.

In a third exemplary embodiment of the expansion device 22" according to the invention, the aerosol generator unit 70', which is illustrated in FIG. 6, takes a simplified form, wherein the receiving chamber 80' adjoins the inlet duct 82 and in relation to the inlet duct 82 of cross section $Q_E$ has a larger cross section $Q_A$, wherein the receiving chamber 80' extends between the inlet duct 82 and a shutter 153 that extends from a side wall of the transfer duct 124 in the direction of the terminating wall 116, and, transversely to the direction of flow 96 and between the transverse wall 104 and an end edge 154 of the shutter, creates a passage 156 through which the working medium entering the receiving chamber 80' can flow in.

In particular, by displacing the shutter 153 the flow cross sectional area of the passage 156 can be adjusted.

However, the passage 156 may also take the form of a passage window.

In particular here, for example the total mass flow G flows along the inlet duct 82 in the direction of flow 96 and is deflected by the shutter 153 into a first direction of flow 132' that runs parallel to the shutter 153, is then deflected by the transverse wall 104 such that the total mass flow G flows through the passage aperture 156 in a direction of flow 134' transverse to the shutter 153, and thereafter undergoes deflection again by an inner wall 162 such that the working medium flows in the direction of the transfer duct 124 in the direction of flow 136', which again runs approximately parallel to the shutter 153, and leaves the exit chamber 110'.

Preferably, in this case the shutter 153 is arranged such that its terminating edge 154 runs above the exit aperture 122, with the result that the concentration section 142' also lies substantially above the exit aperture 122, and thus aerosol particles that are concentrated and made larger are guided through the exit aperture 122 in the direction of flow 138' by the partial flow T of working medium and form the lubricant aerosol mass flow 138' SAe, which is supplied to the lubrication points 72, 74, 76 by way of the line system 144.

Otherwise, all the elements of the third exemplary embodiment that are identical to those of the first exemplary embodiment are provided with the same reference numerals, so reference may be made in full to the statements regarding the first exemplary embodiment.

Figure 7:
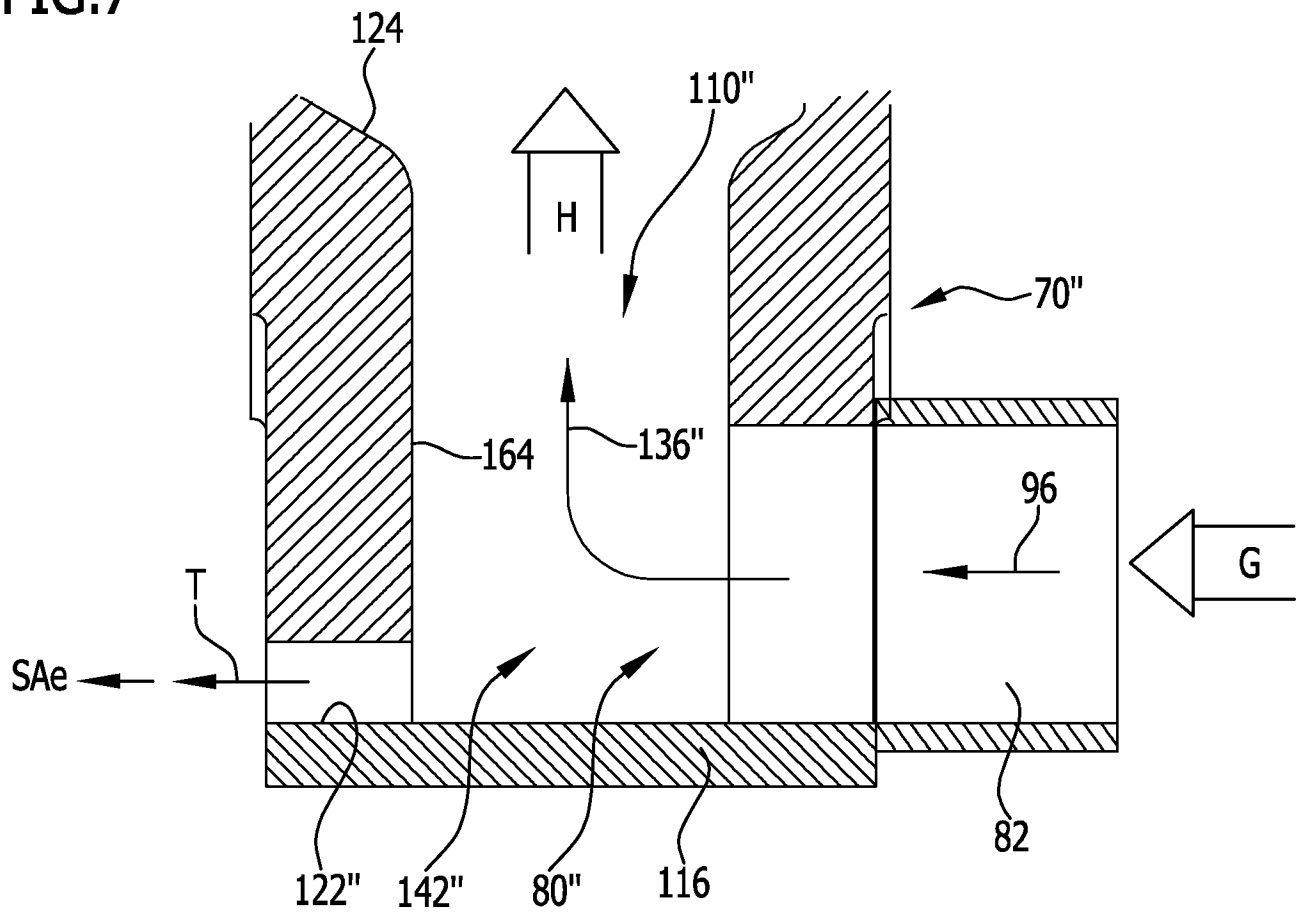
FIG. 7 shows an illustration of the aerosol generator unit, in a fourth exemplary embodiment of an expansion device according to the invention.

In a fourth exemplary embodiment of an expansion device 22 according to the invention, the aerosol generator unit 70", which is illustrated in FIG. 7, takes a simplified form such that the receiving chamber 80" and the exit chamber 110" are not separated from one another.

Rather, the receiving chamber 80" and the exit chamber 110" merge into one another.

However, the receiving chamber 80" and the exit chamber 110" have a side wall 164 that extends transversely to the direction of flow 96 in the inlet duct 82 and deflects the total mass flow G entering the receiving chamber 80" in the direction of flow 96 such that the working medium enters the receiving chamber 110" and then also the transfer duct 124 in the direction of flow 136" approximately parallel to the side wall 164, as a main mass flow H, wherein the working medium guided in the total mass flow G undergoes a deflection through approximately 90° as it forms the main mass flow H.

Because of this deflection through 90°, aerosol particles are concentrated and made larger, wherein these aerosol particles collect in the concentration section 142" between the terminating wall 116 and the side wall 164.

In this exemplary embodiment, the exit aperture 122" is arranged such that it lies directly above the terminating wall 116 and is oriented such that the partial mass flow T that guides the concentrated aerosol particles away, forming the lubricant aerosol mass flow SAe, passes through the exit aperture 122" in a direction of flow 138" that is approximately parallel to the direction of flow 96 in the inlet duct 82 but is laterally offset therefrom.

In all the exemplary embodiments of the expansion device 22 according to the invention that are described above, the lubricant aerosol mass flow SAe guides a proportion of lubricant that has values of at least 2.5 mass % (mass percent) and that may reach values of up to 30 mass % (mass percent).

It is even more preferable if the proportion of lubricant in the lubricant aerosol mass flow SAe has values in the range of from approximately 3 mass % to approximately 20 mass %.

The invention claimed is:

1. An expansion system for a working medium that is used in particular in a circulating process of a system that utilises waste heat, in particular in a system operating in a Rankine cycle, comprising an expansion device coupled to an electricity generator, for the working medium, an inlet for supplying the pressurised working medium, and an outlet for the working medium that has been expanded by the expansion device, an aerosol generator unit that generates a lubricant aerosol is associated with the inlet, wherein the working medium guided to the expansion device flows through this aerosol generator unit, which has a flow guide for the working medium having a concentration section that concentrates lubricant entrained in the total mass flow of working medium supplied to the expansion device to give aerosol particles, and these aerosol particles leave the concentration section together with a partial mass flow of the working medium, branching off from the total mass flow of working medium, as a lubricant aerosol mass flow, and a line system that guides the lubricant aerosol mass flow to lubrication points of an expansion arrangement of the expansion device, for the purpose of aerosol lubrication.

2. An expansion system according to claim 1, wherein the aerosol generator unit deflects the direction of flow in the concentration section of the total mass flow entering therein, for the purpose of forming a main mass flow that is supplied to the expansion arrangement, through overall at least 60°, or preferably through at least 90°, and branches off the lubricant aerosol mass flow from the total mass flow in the region of deflection of the direction of flow.

3. An expansion system according to claim 2, wherein the aerosol generator unit deflects overall the direction of flow in the concentration section of the total mass flow entering therein, for the purpose of forming a main mass flow that is supplied to the expansion arrangement, through overall at least 140°.

4. An expansion system according to claim 1, wherein the lubricant aerosol mass flow flows out of the concentration section of the aerosol generator unit in a direction of flow that forms an angle of at least 60°, in particular an angle of at least 90°, with the direction of flow of the main mass flow that is formed.

5. An expansion system according to claim 4, wherein the lubricant aerosol mass flow flows out of the concentration section of the aerosol generator unit in a direction of flow that forms an overall angle of greater than 140°, preferably overall approximately 180°, with the direction of flow of the main mass flow that is formed.

6. An expansion system according to claim 1, wherein the lubricant aerosol mass flow flows out of the concentration section of the aerosol generator unit in a direction of flow that forms an angle of less than 120°, or preferably an angle of less than 90°, with the direction of flow of the total mass flow entering the concentration section.

7. An expansion system according to claim 1, wherein it has in the concentration section a flow cross section constriction that increases the flow rate.

8. An expansion system according to claim 1, wherein the aerosol generator unit has, downstream of the flow cross section constriction, a flow cross section widening for the purpose of reducing the flow rate of the total mass flow.

9. An expansion system according to claim 1, wherein the aerosol generator unit has a receiving chamber which the total mass flow enters, and wherein the total mass flow flows out of the receiving chamber and into the concentration section.

10. An expansion system according to claim 9, wherein the flow rate is reduced in the receiving chamber, while the flow rate is increased in the concentration section.

11. An expansion system according to claim 1, wherein the concentration section takes a form such that there are provided therein, for the purpose of forming the flow cross section constriction, one or more passage windows or a passage aperture whereof the flow cross sections are smaller than the flow cross section in the receiving chamber.

12. An expansion system according to claim 1, wherein the aerosol generator unit has an exit chamber arranged downstream of the concentration section.

13. An expansion system according to claim 12, wherein the flow rate is reduced in the exit chamber by comparison with the flow rate in the concentration section.

14. An expansion system according to claim 1, wherein the aerosol generator unit has a central chamber and an annular chamber surrounding the latter, wherein the concentration section is arranged in a region of transition from the annular chamber to the central chamber, and wherein either the annular chamber or the central chamber includes the receiving chamber and either the central chamber or the annular chamber respectively includes the exit chamber.

15. An expansion system according to claim 14, wherein the aerosol generator unit has a guide sleeve that separates the annular chamber from the central chamber, and at the end whereof there is arranged the concentration section.

16. An expansion system according to claim 14, wherein the guide sleeve takes a form such that at the end thereof it has the flow cross section constriction in the concentration section.

17. An expansion system according to claim 14, wherein the annular chamber includes the receiving chamber such that the total mass flow enters the annular chamber and passes from the annular chamber via the concentration section into the exit chamber, and wherein in particular a passage window is arranged in the concentration section.

18. An expansion system according to claim 1, wherein there adjoins the concentration section an exit aperture through which the lubricant aerosol mass flow passes.

19. An expansion system according to claim 18, wherein the exit aperture is provided in a wall delimiting the concentration section.

20. An expansion system according to claim 18, wherein the exit aperture is arranged in the region of the flow cross section constriction.

21. An expansion system according to claim 18, wherein the exit aperture is arranged downstream of the flow cross section constriction.

22. An expansion system according to claim 1, wherein the expansion arrangement is a screw expansion arrangement that includes two screw rotors engaging in one another.

23. An expansion system according to claim 22, wherein the lubricant aerosol mass flow is supplied to at least one point on the respective screw rotor bore receiving a screw rotor.

24. An expansion system according to claim 23, wherein the lubricant aerosol mass flow of the respective screw rotor bore is supplied to a plurality of points corresponding to different expansion states.

25. An expansion system according to claim 1, wherein the lubricant aerosol mass flow is supplied to at least one bearing unit of the expansion arrangement.

26. An expansion system according to claim 1, wherein the lubricant aerosol mass flow is supplied at the respective point by way of a nozzle that distributes the lubricant aerosol mass flow.

27. A method for operating an expansion system for a working medium that is used in particular in a circulating process of a system that utilises waste heat, in particular in a system operating in a Rankine cycle, comprising an expansion device coupled to an electricity generator, for the working medium, an inlet for supplying the pressurised working medium, and an outlet for the working medium that has been expanded by the expansion device, the working medium is guided in an aerosol generator unit that generates a lubricant aerosol and is associated with the inlet such that lubricant entrained in the total mass flow of working medium guided to the expansion device is concentrated to give aerosol particles, and from these aerosol particles, together with a partial mass flow of the working medium, branching off from the total mass flow of working medium, there is formed a lubricant aerosol mass flow, which is supplied to lubrication points of an expansion arrangement of the expansion device by a line system.

28. A method according to claim 27, wherein the direction of flow of the total mass flow entering a concentration section in the aerosol generator unit is deflected therein, for the purpose of forming a main mass flow that is supplied to the expansion arrangement, through at least 60°, and wherein the lubricant aerosol mass flow branches off from the total mass flow in the region of deflection of the direction of flow.

29. A method according to claim 27, wherein in the aerosol generator unit, the lubricant aerosol mass flow flows away, in the region of a deflection of flow from the direction of flow of the total mass flow into the direction of flow of the main mass flow, in a direction of flow that is different from the direction of flow of the main mass flow.

30. A method according to claim 27, wherein in the concentration section of the aerosol generator unit, the lubricant aerosol mass flow is guided away in a direction of flow that forms an angle of at least 60°, and more preferably at least 140°, preferably approximately 180°, with the direction of flow of a main mass flow that is flowing away.

31. A method according to claim 27, wherein in a concentration section of the aerosol generator unit, the lubricant aerosol mass flow is guided away in a direction of flow that forms an angle of less than 90°, more preferably less than 45°, and even more preferably less than 20°, with the direction of flow of the total mass flow entering the concentration section.

32. A method according to claim 27, wherein the flow rate is increased in the aerosol generator unit at the location of formation of the lubricant aerosol mass flow from the total mass flow.

33. A method according to claim 27, wherein the flow rate of the total mass flow is reduced in the aerosol generator unit downstream of the flow cross section constriction.

* * * * *